US007654801B2

(12) United States Patent
Spude

(10) Patent No.: US 7,654,801 B2
(45) Date of Patent: Feb. 2, 2010

(54) HYDRAULICALLY-ACTUATED DIAPHRAGM PUMP WITH A LEAK COMPENSATION DEVICE

(75) Inventor: Gaetan Spude, Le Petit Quevilly (FR)

(73) Assignee: Milton Roy Europe, Pont-Saint-Pierre (FR)

( * ) Notice: Subject to any disclaimer, the term of this patent is extended or adjusted under 35 U.S.C. 154(b) by 450 days.

(21) Appl. No.: 11/636,442

(22) Filed: Dec. 11, 2006

(65) Prior Publication Data

US 2007/0140878 A1 Jun. 21, 2007

(30) Foreign Application Priority Data

Dec. 20, 2005 (FR) ..... 05 12938

(51) Int. Cl.
*F04B 43/067* (2006.01)

(52) U.S. Cl. ..... 417/386; 417/388; 417/395; 92/86

(58) Field of Classification Search ..... 60/455; 92/86, 96; 417/383, 385, 386, 387, 388, 417/395

See application file for complete search history.

(56) References Cited

U.S. PATENT DOCUMENTS 2,919,650 A * 1/1960 Wiggermann ..... 417/386
3,769,879 A * 11/1973 Lofquist, Jr. ..... 92/84
3,884,598 A * 5/1975 Wanner ..... 417/386
RE29,055 E * 11/1976 Wagner ..... 417/388
4,416,599 A * 11/1983 De Longchamp ..... 417/386
4,619,589 A 10/1986 Muller et al.
5,246,351 A * 9/1993 Horn et al. ..... 417/387
5,707,219 A 1/1998 Powers et al.
6,481,982 B1 * 11/2002 Yokomichi ..... 417/395
7,090,474 B2 * 8/2006 Lehrke et al. ..... 417/395
7,425,120 B2 * 9/2008 Hembree ..... 417/387

FOREIGN PATENT DOCUMENTS

FR 2164025 * 7/1973
FR 2671139 A1 * 7/1992
JP 59122788 A * 7/1984
JP 59122789 A * 7/1984
JP 59122790 A * 7/1984

* cited by examiner

*Primary Examiner*—Devon C Kramer
*Assistant Examiner*—Nathan Zollinger
(74) *Attorney, Agent, or Firm*—Young & Thompson

(57) ABSTRACT

A diaphragm pump including, in a pump body, a hydraulic control chamber disposed between a piston for executing reciprocating motion and the diaphragm, the pump including elements for compensating leaks from the hydraulic chamber, the elements including a refilling duct opening out into the hydraulic chamber via a normally-closed compensation shutter that is driven into the open position by the diaphragm, wherein the above-mentioned compensation shutter being driven by the diaphragm pressing against a free end of a rod for controlling the shutter, the diaphragm being subjected to the force of a suction-assistance spring which co-operates with the above-mentioned shutter to return it to its closed position by pushing the free end of the control rod back towards the diaphragm, the spring co-operating with the shutter to form a moving assembly that is moved without being deformed by the diaphragm during suction overtravel.

6 Claims, 2 Drawing Sheets

HYDRAULICALLY-ACTUATED DIAPHRAGM PUMP WITH A LEAK COMPENSATION DEVICE

The present invention relates to a hydraulically-actuated diaphragm pump with the diaphragm being protected in the event of hydraulic fluid leaks from the drive chamber.

BACKGROUND OF THE INVENTION

Overtravel on suction is due to a lack of liquid in the hydraulic chamber for driving the diaphragm. In reality, in certain types of pump, this overtravel does not occur since, at the end of the suction stroke, the diaphragm comes to bear against a surface for limiting its stroke. This can lead to cavitation occurring in the hydraulic chamber, and in any event the cubic capacity of the pump is reduced. In certain pumps where there are no mechanical limits on the suction stroke of the diaphragm, overtravel can not only reduce performance, but can also lead to excessive fatigue and deformation of the diaphragm that are harmful for its length of life.

Overtravel on delivery is the result of excess liquid in the hydraulic chamber for driving the diaphragm. This situation can be encountered, for example, if the pump has been stopped for a long time while suction becomes established in the working chamber. The hydraulic control chamber sees its volume increased little by little and filled with fluid coming from the reservoir via capillary channels due to mechanical clearances that allow operation. Next time the pump is started, the diaphragm might tear.

These phenomena are well known and numerous devices exist for remedying them. Mention can be made of pumps having a rear plate or a grid against which the diaphragm can bear and a rated check valve for refilling the chamber that opens when a suction threshold is reached in the hydraulic chamber. If the threshold is large, the expansion of the oil in the hydraulic chamber is excessive and flow rate stability suffers. It has also been found that there is a suction peak at the beginning of the suction stage due to the inertia of the moving elements and that can give rise to premature opening of the rated valve, leading to overcompensation that is harmful for delivery.

Document FR 2 557 928 describes leak compensation means that are automatic, given the principle on which the pump operates. That system is also liable to suffer from overcompensation.

Mention is also made of document EP 0 547 404. The device described therein makes use of valves whose opening or closing is associated with the position reached by the diaphragm.

Thus, in order to eliminate delivery overtravel, a valve interrupts communication between two portions of the hydraulic chamber, thereby isolating the fluid in contact with the diaphragm from the fluid in contact with the piston when the diaphragm has reached an end-of-delivery reference position. The excess drive fluid is then diverted to a sump via a relief valve.

Similarly, in order to eliminate suction overtravel, a valve opens when the diaphragm reaches an end-of-suction reference position. That opening puts the hydraulic chamber into communication with an oil sump via a refilling duct and an additional movement of the piston causes a compensation volume of oil to be sucked into the hydraulic chamber.

For it to be possible for the compensation valve that is controlled or driven by the diaphragm to change state, the diaphragm must develop a force suitable for overcoming the opposing force from a spring that holds the valve in its state in which it closes the refilling duct. This force that needs to be overcome puts a limit on the amount of suction the pump can deliver. In other words, in the event of the pump operating with reduced pressure on suction, it can happen that the compensation device does not operate, with cavitation then starting in the hydraulic drive chamber without it being possible for the valve to open. It can thus be understood that it would be most advantageous to reduce the force of the spring urging the valve against its seat so as to avoid excessively penalizing the operation of the pump during suction. However it is hardly possible to reduce this force below a value corresponding to a pressure of 0.3 bars (3 meters of water column or 300 hectopascals).

Diaphragm pumps fitted with a leak compensation system driven by the diaphragm thus present mediocre suction power.

OBJECT OF THE INVENTION

The present invention relates to a pump in which compensation for leaks from the hydraulic chamber is under driven control and in which suction power is considerably improved.

BRIEF DESCRIPTION OF THE INVENTION

The invention thus provides a diaphragm pump comprising, in a body, a hydraulic control chamber disposed between a piston for executing reciprocating motion and the diaphragm, the pump including means for compensating leaks from the hydraulic chamber, said means including a refilling duct opening out into the hydraulic chamber through a compensation shutter that is driven into the open position by the diaphragm.

In accordance with a main characteristic of the invention, the above-mentioned compensation shutter is driven by the diaphragm bearing against a free end of a rod for controlling the shutter while the diaphragm is subjected to the return force of a suction-assistance spring that co-operates with the above-mentioned shutter in order to return it to its closed state by pushing the free end of the rod back towards the diaphragm, said spring together with the shutter forming a moving assembly that is moved without being deformed by the diaphragm in the event of suction overtravel.

The suction-assistance spring bears, at a distance from the shutter, against a shoulder situated at the end of a rod secured to the diaphragm and extending from the diaphragm into the hydraulic chamber of the pump.

This particular disposition has the advantage of sparing the action of opening the compensation shutter from any need to overcome the force used for keeping it in its closed state. This increases the amount of suction that can be obtained, coming close to 10 meters of water column as compared with the usual 7 meters. The shutter and the shoulder move along a direction that is the direction in which the diaphragm moves.

In operation, the force for holding the compensation shutter in its closed state varies as a function of the greater or smaller compression of the spring since there is relative movement between the shoulder against which the spring bears and the compensation shutter.

Furthermore, the force of this spring tending to return the diaphragm to the rear position thus adds to a force to be overcome during the delivery stroke. This addition leads to the pressure that exists in the hydraulic control chamber being always greater than the pressure that exists in the working chamber, which presents advantages, in particular in terms of reducing the amount of degassing from the working oil.

Two embodiments are possible for the compensation shutter, either an embodiment in the form of a slide valve or an embodiment in the form of a lift-off valve. Furthermore, the shoulder against which the spring secured to the diaphragm bears can serve to limit the delivery stroke of the diaphragm, either by acting as an abutment, or else by acting as a valve for isolating a portion of the control chamber adjacent to the diaphragm from the remainder of said chamber adjacent to the piston and provided with a relief valve.

Other characteristics and advantages appear from the description given below of embodiments of the diaphragm pump of the invention.

BRIEF DESCRIPTION OF THE DRAWINGS

Reference is made to the accompanying drawings, in which.

DETAILED DESCRIPTION OF THE INVENTION

Figure 1:
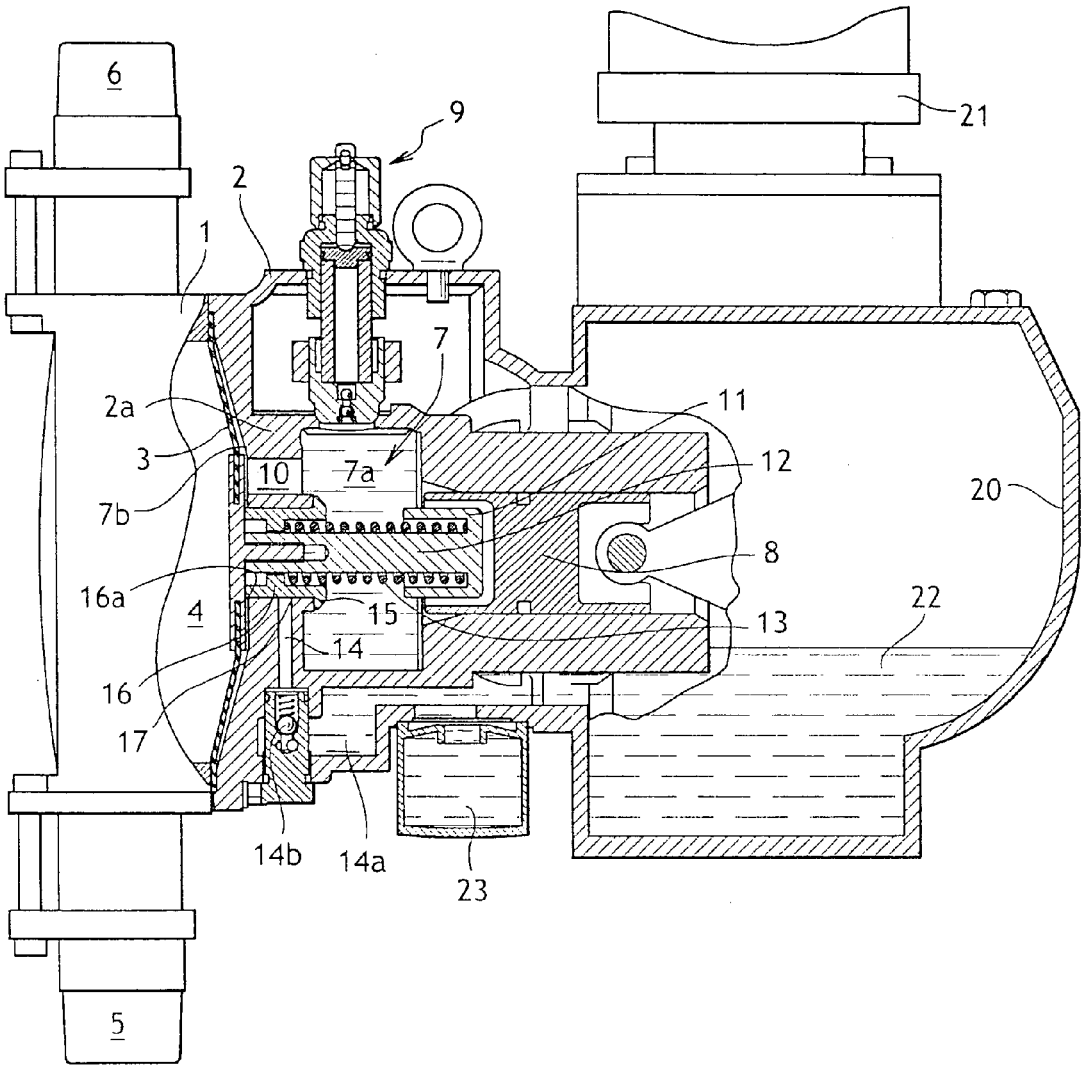
FIG. 1 is a section view of a pump in accordance with the invention.

In conventional manner, a hydraulically-controlled diaphragm pump comprises a pump body made up of two portions 1 and 2 having the periphery of a diaphragm 3 pinched between them.

Together with the portion 1 of the body, the diaphragm defines a pump chamber 4 in which there terminates a suction duct 5, and a delivery duct 6, both fitted with check valves (not shown).

Together with the portion 2 of the body, the diaphragm defines a chamber 7 filled with a hydraulic fluid that can be displaced cyclically forwards (to the left of the figure) or rearwards by means of a piston 8 driven with reciprocating motion. This provides a hydraulic control for varying the volume of the pump chamber 4.

The chamber 7 is also fitted in conventional manner with a relief valve 9 serving to limit the delivery pressure to a determined safe value and which is often combined with a device for degassing the control fluid.

In FIG. 1, it should be observed that the chamber 7 presents two portions. A generally cylindrical portion 7*a* beside the piston 8, and a portion 7*b* that flares beside the diaphragm 3. The portions 7*a* and 7*b* are interconnected through a partition 2*a* by a connection duct 10.

A refilling duct 14 is provided in the body 2 (the partition 2*a*) and comes from an oil sump 14*a*, being fitted with a check valve 14*b*. The duct 14 opens out into the chamber 7 whenever said opening is uncovered by a shutter member 15 which normally isolates the duct 14 from the chamber 7.

The shutter member 15 is a lift-off valve fitted with a tubular drive rod 16 slidably mounted in leaktight manner through the wall 2*a* of the portion 2 of the body and having its end 16*a* remote form the lift-off valve 15 adjacent to the diaphragm 3 when the diaphragm comes close to a reference position that it reaches at the end of a suction stroke.

When resting against the wall 2*a*, the lift-off valve 15 closes the outlet of an annular channel 17 formed at least in part around the rod 16 connected to the lift-off valve and into which the end of the duct 14 opens out. The rod 16 of the lift-off valve 15 forms a sleeve in which there slides a rod 12 that is secured to the diaphragm 3. This rod 12 is fitted at its free end with a shoulder 11 (bell-shaped in this example) to form an abutment for a spring 13 that provides assistance to the diaphragm 3 during suction and whose other end bears against the lift-off valve 15 tending to press it against the wall 2*a*.

The stiffness of the diaphragm is such that in the absence of any suction it tends to open the lift-off valve 15, thus when the diaphragm 3 reaches its reference position, a position that corresponds to the diaphragm being in a rest configuration, it can already have moved the lift-off valve 15 and opened up communication between the duct 14 and the chamber 7. Such opening is achieved without any need to overcome a force since when the diaphragm comes into contact with the control rod 16 for the lift-off valve 15, the force of the spring on the lift-off valve 15 is canceled. This force then acts between the shoulder 11 and the diaphragm 3 which together constitute a non-deformable moving assembly taking along the lift-off valve 15. No force is thus required to open the compensation valve and during a suction stage the pressure in the chamber 7 is substantially equal to the pressure in the pump chamber 4, thus enabling suction to be implemented with a large amount of vacuum, and in any event a pressure of less than 0.3 bars.

At the beginning of the delivery stroke, the lift-off valve 15 closes and it then becomes necessary to overcome the force of the spring 13 before it is possible to move the diaphragm 3 forwards. The pressure in the chamber 7 is then always greater than the pressure in the pump chamber 4, which is favorable to good operation of the pump (less degassing of any dissolved gas, for example). At the end of the delivery stroke, the shoulder 11 can limit the stroke of the diaphragm 3 by bearing against the lift-off valve 15 or the wall 2*a*.

Figure 2:
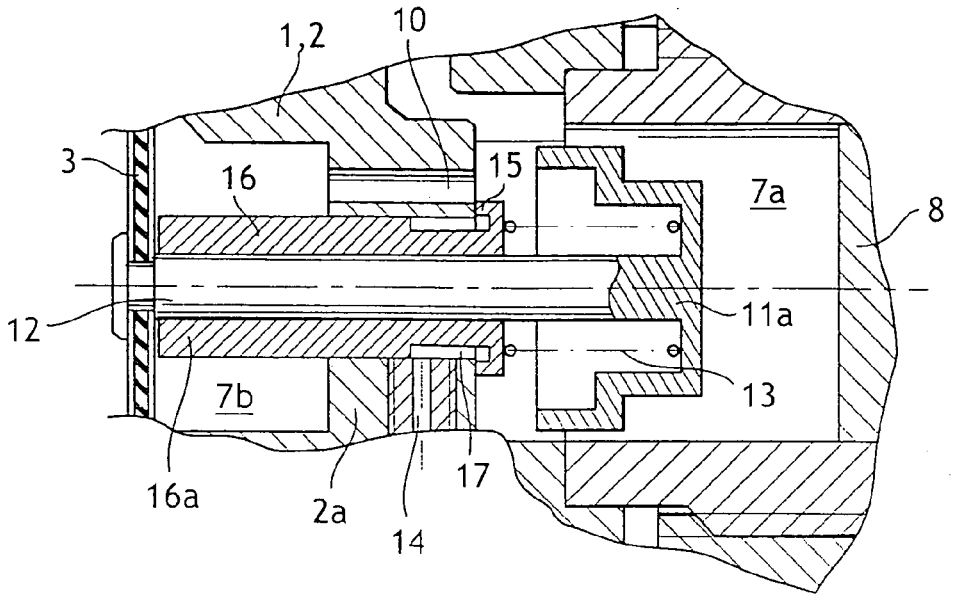
FIG. 2 is a fragmentary view showing a variant embodiment in which the diaphragm is protected against delivery overtravel.

In the variant shown in FIG. 2, the shoulder 11 is in the form of a bell 11*a* that forms a valve suitable for closing the outlet of the channel 10 into the portion 7*a* of the hydraulic chamber and that isolates the portion 7*b* of said portion 7*a* when the diaphragm 3 goes past the end-of-delivery reference position. This portion 7*a* is permanently in communication with the relief valve 9, such that any continued stroke of the piston 8, after the end-of-delivery position has been reached by the diaphragm 3, leads to excess fluid being diverted through the relief valve 9 to an oil sump.

Figure 3:
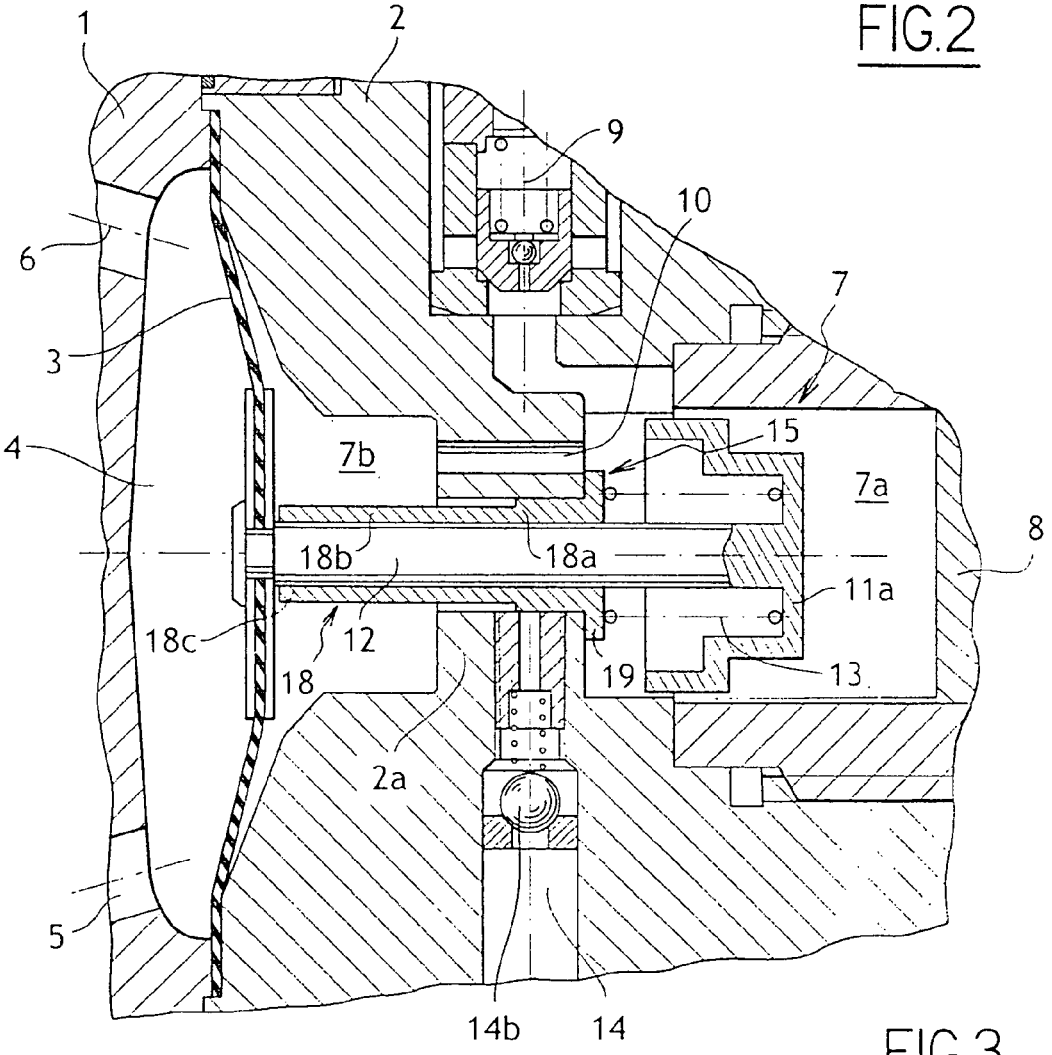
FIG. 3 shows a variant embodiment of the compensation shutter.

In FIG. 3, the shutter member 15 is constituted by a slide valve 18 slidably mounted in a bore in the partition 2*a* of the body 2 of the pump. The slide valve 18 is tubular and has a collar 19 at its end remote from the diaphragm, with the spring 13 pressing thereagainst and also pressing under the shoulder 11 (valve 11*a*), thus tending to press the collar 19 again the partition 2*a* of the body 2 through which the connection duct 10 passes. The outside diameter of the slide valve 18 is stepped so that a large-diameter portion 18*a* covers the outlet of the duct 14 into the bore when the collar 19 is pressed against the partition 2*a*. When the collar 19 is remote from the partition 2*a*, the small-diameter portion 18*b* of the slide valve 18 uncovers the outlet of the duct 14 and the chamber 7 can be refilled by suction.

The slide valve 18 forms a sleeve in which the rod 12 of the valve 11*a* or of the shoulder 11 slides. The end 18*c* of the slide that is remote from the collar 19 is situated close to the reference position reached by the diaphragm at the end of the suction stroke.

The outlet of the duct 14 into the bore in the partition 2*a* is uncovered as soon as the diaphragm 3 has reached its end-of-suction reference position, i.e. as soon as it comes into contact with the end 18*c* of the slide valve 18, thereby producing the same effects as those described with reference to FIGS. 1 and 2.

Returning to FIG. 1, it can be seen that the portion 2 of the pump body constitutes the enclosure of the hydraulic chamber 7. This enclosure belongs to a general structure 20 that also forms a support for a drive motor 21 and a casing for a transmission mechanism between the motor 21 and the piston 8, which mechanism is not shown and generally consists in a system comprising a wheel and a wormscrew, the wheel being fitted with an eccentric for driving the piston back and forth.

The casing also contains a bath of lubricating oil 22 for the transmission mechanism. The casing 20 communicates with the sump 14*a* of the portion 2 of the pump body via a filter 23. Thus, when there is a need for compensation in the chamber 7, fluid is taken from the sump 14*a* which consequently fills up using lubricating oil taken through the filter 23, itself coming from the bath in the casing 20. It should be observed in this figure that the fluid of the chamber 7 diverted via the relief valve 9 returns to the casing 20 in the bath 22.

This disposition simplifies construction of the pump. Prior art pumps using a compensation valve controlled by the diaphragm all possess a separate fluid for the hydraulic control chamber, in order to guarantee its purity, given that a lubricating fluid becomes progressively filled with particles coming from the moving parts it lubricates. In order to be able to conserve an acceptable amount of suction, the rated valve must be rated to a minimum level, thus involving forces that are very small in order to obtain displacement. These forces can be smaller than those needed to overcome the unwanted friction forces generated by any particles that might be jamming the valve. The means of the invention make it possible to do without the valve return spring and its force for compensation purposes: that makes it possible to admit fluid that is less pure.

What is claimed is:

1. A diaphragm pump: comprising:

a pump body;

a hydraulic control chamber, in said pump body, disposed between a piston and a diaphragm;

means for compensating leaks from the hydraulic control chamber, said means comprising a refilling duct opening out into the hydraulic control chamber via a compensation shutter configured to be driven between a closed first position and an open second position by the diaphragm, the diaphragm being subjected to a force of a suction assistance spring, wherein the compensation shutter has a control rod with a free end facing the diaphragm, the compensation shutter configured to be driven to the open second position by the diaphragm pressing against said free end of said control rod during a suction overtravel, said suction-assistance spring being between said compensation shutter and a shoulder carried by the end of a second rod secured to the diaphragm and extending along an axis of the shutter to return the diaphragm toward said free end of the control rod, said suction-assistance spring being biased to return the compensation shutter to the closed first position, and wherein said suction-assistance spring and said compensation shutter form a moving assembly that is movable as a non-compressible assembly by the diaphragm during suction overtravel.

2. The diaphragm pump according to claim 1, wherein the compensation shutter is a liftoff valve.

3. The diaphragm pump according to claim 1, wherein the compensation shutter is a slide valve.

4. The diaphragm pump according to claim 1, wherein the shoulder constitutes an abutment for limiting displacement of the diaphragm at an end of a delivery stroke.

5. The diaphragm pump according to claim 4, wherein the hydraulic control chamber is in two portions, a first portion being in a vicinity of the piston and a second portion in a vicinity of the diaphragm, the first and second portions being interconnected by a channel, and the abutment forming a channel valve for shutting the outlet of the channel into the first portion.

6. The diaphragm pump according to claim 1, further comprising:

a drive motor;

a general structure forming a support for the drive motor; and a casing for a mechanism for transmitting drive from the drive motor to the piston, and for a bath of oil for lubricating the mechanism, wherein the hydraulic control chamber is in permanent communication with the casing via the refilling duct and a filter.

* * * * *

UNITED STATES PATENT AND TRADEMARK OFFICE

CERTIFICATE OF CORRECTION

PATENT NO. : 7,654,801 B2
APPLICATION NO. : 11/636442
DATED : February 2, 2010
INVENTOR(S) : Gaetan Spude It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 503 days.

Signed and Sealed this

Twenty-eighth Day of December, 2010

David J. Kappos

David J. Kappos
*Director of the United States Patent and Trademark Office*